United States Patent [19]

Garcia et al.

[11] 4,271,621

[45] Jun. 9, 1981

[54] CONVERSION UNIT FOR ELECTRICAL LIGHT FIXTURE

[75] Inventors: Octavio G. Garcia, Prairie Village, Kans.; Peter A. Lambert, Excelsior Springs, Mo.

[73] Assignee: Devine Lighting, Incorporated, Kansas City, Mo.

[21] Appl. No.: 27,873

[22] Filed: Apr. 6, 1979

[51] Int. Cl.[3] ..... G09F 13/04

[52] U.S. Cl. ..... 40/570; 40/573; 362/183

[58] Field of Search ..... 40/570, 573; 362/183, 362/184, 190, 191, 194, 812

[56] References Cited

U.S. PATENT DOCUMENTS

| | | | |
|---|---|---|---|
| 2,952,079 | 9/1960 | Koch | 40/573 |
| 3,225,476 | 12/1965 | Bockmann | 40/549 X |
| 3,659,179 | 4/1972 | Barker | 362/183 X |
| 3,892,080 | 7/1975 | Koch | 40/573 |
| 3,931,689 | 1/1976 | Shine | 40/570 |

OTHER PUBLICATIONS

Lightalarms Electronics Corporation, "Self-Powered Exit Signs", 8D1-7BA (112575-1).

Sure-Lites Incorporated, "Exit Sign"-Brochure, SL-120-5-78.

Chloride Systems, 6-VOH Self Powered Exit Signs Series SPE/OPE, 1975.

Dualite, Inc., "Exquisite Self-Contained Emergency Lighting Exits," 60-209R, Feb. 1976.

Lithonia, "Fail-Safe Exit Sign" Section EL, Sheet 3.

*Primary Examiner*—Gene Mancene

*Assistant Examiner*—G. Lee Skillington

*Attorney, Agent, or Firm*—Schmidt, Johnson, Hovey & Williams

[57] ABSTRACT

A conversion kit or assembly for standard exit sign constructions is provided which allows quick and easy changeover of the sign (which is normally illuminated only by standard 120 volt building current) to a design wherein a secondary source of illumination and electrical power is provided for emergency use. The conversion kit includes a replacement support housing having a battery and printed circuit board therein, along with secondary bulbs designed for quick attachment within the sign lens unit, and wiring means for connecting the primary and secondary illuminators to respective power sources. The secondary bulbs are wired to light only upon a failure of normal power, so as to ensure operation of the exit sign. A test switch is also provided for periodically testing the secondary illumination system.

2 Claims, 3 Drawing Figures

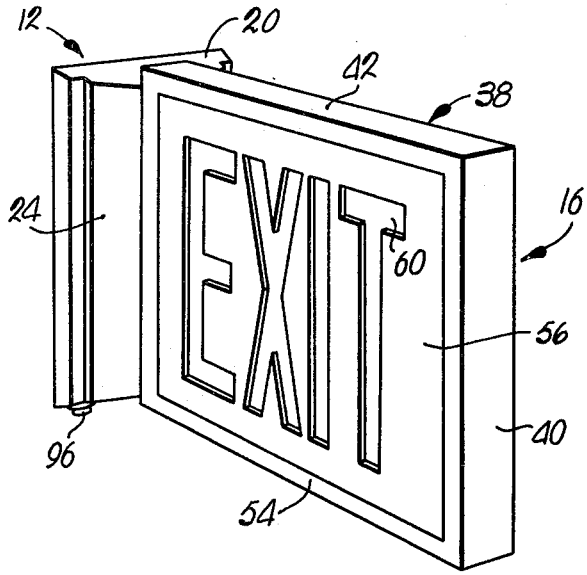
Fig. 1.
Fig. 2.
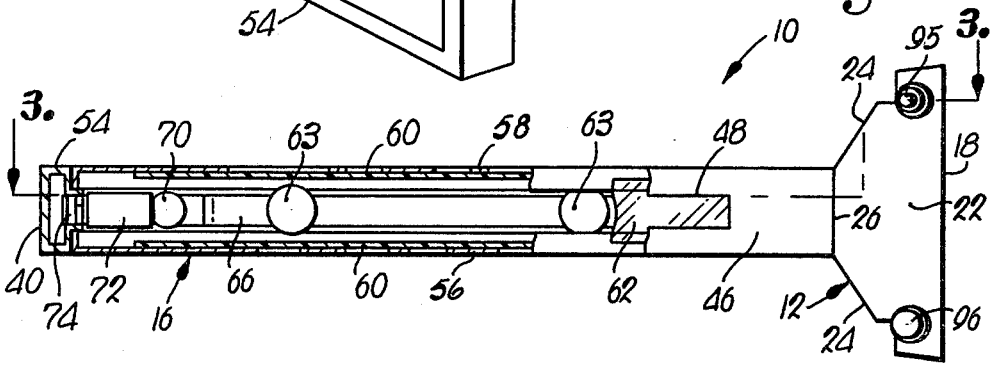
Fig. 3.
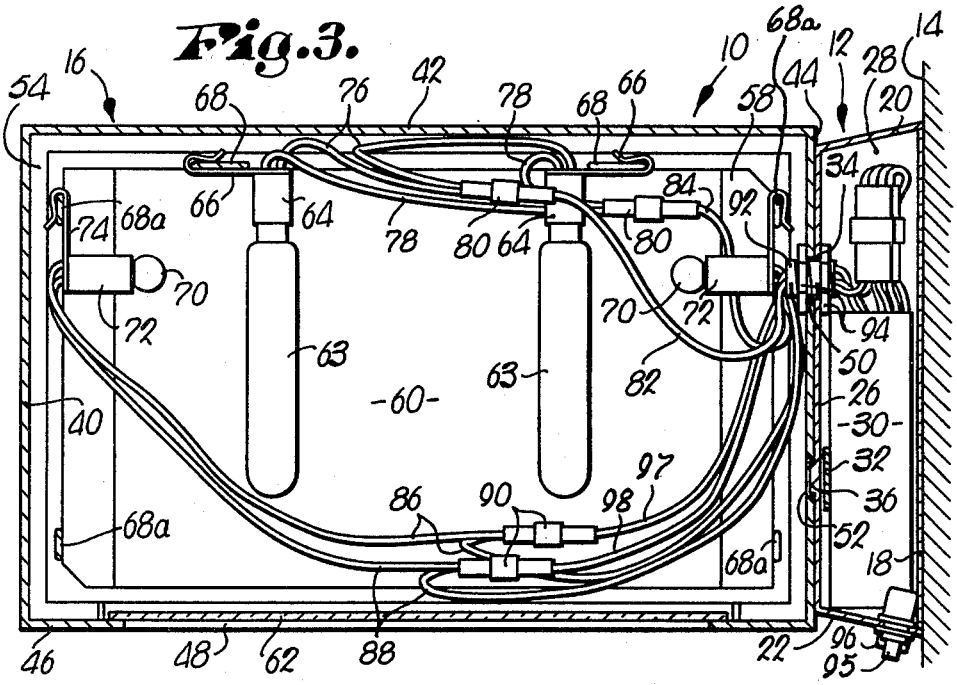

CONVERSION UNIT FOR ELECTRICAL LIGHT FIXTURE

BACKGROUND OF THE INVENTION

I. Field of the Invention

The present invention is concerned with an improved exit light construction which is modified to include a secondary or emergency illumination system for use in the event that building power is discontinued. More particularly, the invention is concerned with a conversion kit or assembly for quickly and easily converting the standard exit signs now in use to units having a desirable secondary illumination system.

II. Description of the Prior Art

Standard exit signs are a common and everyday feature in most public buildings. Generally speaking, these units include an elongated, hollow support housing adapted to be secured to a support surface such as a wall or the like adjacent to an exit doorway, and a rectangular, illuminated exit-indicating lens unit secured to the housing. The lens unit preferably includes a pair of spaced, light-transmitting diffusion panels, along with one or more electrically powered bulbs therebetween. The bulbs are normally powered by conventional building current, and are simply wired directly to the building wiring.

Modern day fire and building codes oftentimes require that exit signs be provided with emergency illumination means. Thus, in the event of a fire or other emergency which cuts the normal building current, the exit signs remain illuminated for approximately 90 minutes to facilitate egress of people from the building. As can be appreciated, the purpose of exit signs is in large measure defeated if they fail to operate during a time when individuals within the building are in most need of information to facilitate rapid evacuation of the building.

It will also be appreciated that the cost of replacing all existing exit signs with entirely new units having a secondary illumination feature would be a considerable expense. Therefore, there is a need in the art for a means of converting existing exit signs to provide the desirable emergency illumination feature. Of course, to be truly effective any conversion kit or assembly must be relatively quick and easy to install.

SUMMARY OF THE INVENTION

The present invention solves the problems outlined above by provision of a conversion kit for standard electrical wiring. Specifically, the kit includes a replacement support housing which is, in its outside dimensions, virtually identical with the original housing, but includes a battery therewithin for emergency illumination purposes. At least one (and preferably two) bulbs are also provided with the kit, and include clip structures allowing the bulbs to be easily secured in place within the lens unit of the sign. Finally, quick connect, wires which, if desired, may be color-coded are provided for interconnecting the standard primary illumination bulbs to building current, while connecting the secondary bulbs to the battery or battery pack. In addition, the latter includes conventional electrical means for assuring that the secondary bulbs are energized in the event that normal building current is discontinued. Finally, a test circuit is provided on the housing for periodic testing of the secondary illumination system.

BRIEF DESCRIPTION OF THE DRAWING

FIG. 1 is a perspective view of an exit sign modified in accordance with the invention with the conversion kit hereof;

FIG. 2 is a bottom view with parts broken away for clarity which illustrates the sign construction; and FIG. 3 is a sectional view taken along irregular line 3—3 of FIG. 2 which further illustrates the internal construction of the converted exit sign.

DESCRIPTION OF THE PREFERRED EMBODIMENT

Turning now to the drawing, an exit sign 10 modified in accordance with the invention is illustrated in FIGS. 1–3. Broadly, the sign 10 includes an elongated, hollow support housing 12 adapted for connection to a vertical surface such as a wall 14, along with a rectangular, laterally extending, exit-indicating lens unit 16 secured to the housing 12.

In more detail, housing 12 includes a planar back wall 18, top and bottom walls 20, 22, irregular, converging, elongated sidewalls 24, and a planar, apertured front wall 26 which is parallel with the wall 18. The walls 18–26 cooperatively define an elongated, upright, hollow chamber 28 which is adapted to completely receive a battery pack 30. To this end, a battery-retaining clip 32 is provided within housing 28. Also, it will be seen that the front wall 26 is provided with an aperture 34 therethrough, and a lower projection 36.

Lens unit 16 is of substantially rectangular configuration and includes a unitary, circumscribing frame 38 having rectangular front, top and rear walls respectively numbered 40, 42 and 44. The bottom wall 46 is provided with an elongated rectangular opening 48 (see FIG. 2), while rear wall 44 has an opening 50 therein adapted to mate with operture 34, and a recess 52 adapted to receive projection 36. Frame 38 further includes respective, inwardly extending margins 54 which are continuous and are connected to the opposite peripheries of the frame-defining walls.

Lens unit 16 also includes front and back walls 56 and 58 which are each metallic and have cut therefrom the letters of the word "EXIT." Corresponding colored (red) diffuser panels 60 are disposed adjacent the inner faces of the walls 56, 58, and cover the cut out letters.

A fluted light diffuser 62 of rectangular configuration is placed adjacent to the inner face of bottom wall 46 in covering relationship to the opening 48 (see FIG. 3).

Primary illumination bulbs 63 are disposed between the panels 60. For this purpose, respective sockets 64 are provided, with each of the sockets being equipped with an elongated, transversely extending resilient metallic clip 66. The clips 66 fit over and engage tongue-like projections 68 which are provided adjacent the top wall 42 as illustrated. In this regard, it will be noted that additional projections **68*a* are provided adjacent the front and rear walls 40, 44**, and this is important for purposes to be described.

Secondary or emergency illumination means in the form of a pair of light bulbs 70 are likewise disposed within the lens unit 16. Specifically, a socket 72 having a resilient metallic clip 74 is provided for each bulb, with the respective clip being mounted over the projections **68*a* as best seen in FIG. 3**.

The primary bulbs 63 are powered by the standard 120 volt building current. For this purpose, corresponding wiring leads 76 and 78 are provided, and the mated pairs of leads have electrical quick-connect structures 80 on the outermost ends thereof. Hot and neutral wires 82, 84 are respectively connected to the structure 80 for providing electrical current to the parallel connected bulbs 63 in the well known manner. In a similar fashion, wiring leads 86 and 88 extend from the sockets 72 and, at the outermost ends of the mated leads, quick-connect structures 90 are provided. Corresponding leads 97, 98 from the battery pack 30 are adapted for connection to the structures 90 in the well known manner.

Preferably, the wiring for the primary and secondary bulbs 63, 70 is done by conventional means such that, when normal building current is maintained, the bulbs 63 are illuminated; however, in the event that such normal building service is interrupted, the battery pack 30 serves to energize the secondary bulbs 70. Such a wiring scheme is well known and the particulars thereof need not be described in detail. However, it is noted that the wiring from the chamber 28 passes through the apertures 34, 50 into the interior of the lens unit 16. Moreover, a threaded sleeve 92 and corresponding nuts 94 are preferably employed for interconnecting the housing 12 and lens unit 16, and, as seen, the wiring passes through the interior of the sleeve 92.

Conventional test circuitry is also provided with the sign 10 and includes a switch 95 and a ready light 96. This test circuitry is wired such that the switch 95 can be depressed and, if battery pack 30 is fully charged and all other wiring relating to the secondary illumination system is in order, the ready light 96 will be illuminated. Here again, such circuitry is conventional and well known, and need not be described in detail.

In use of the conversion kit or assembly in accordance with the invention, a standard, preexisting exit sign can be modified in a very short time to provide a secondary, emergency illumination system. The unmodified unit would be substantially as illustrated in FIG. 1, but would have a hollow housing only and would not be provided with battery pack 30 or the associated structure described above.

In modifying such a preexisting unit, the lens unit would be temporarily removed and a new housing 12 having the battery pack 30 therein would be installed. At this point the secondary illuminators would be positioned within the lens unit simply by pressing the clips 74 over the appropriate projections 68*a*. The wiring for the unit would then be connected (this may be greatly facilitated by using color coded wiring) whereupon the lens unit would be reconnected to the new support housing. At this point the sign would be completely converted and ready for use.

Having thus described the invention, what is claimed as new and desired to be secured by Letters Patent is:

1. In an illuminated exit sign construction of the type including an elongated, hollow support housing secured to a support surface, a rectangular, exit-indicating lens unit secured to the housing and having at least one lens panel and a primary electrical illuminator behind said panel, and means for coupling said primary illuminator to a source of standard voltage electricity, the improvement which comprises:

a battery;

means for mounting said battery wholly within said housing, the housing being directly connected to and carrying the lens unit on one face thereof and being secured directly to the support surface on the other face thereof;

a secondary electrical illuminator disposed within said lens unit;

means electrically connecting said secondary illuminator to said battery for energizing the secondary illuminator; and an internal, transversely extending support element on said lens unit, there being clip means on said secondary illuminator for connecting the latter to the support element.

2. The exit sign construction as set forth in claim 1 including means for selective testing of the operability of said battery and secondary illuminator.

* * * * *